US005765311A

United States Patent [19]

Kapler

[11] Patent Number: 5,765,311

[45] Date of Patent: Jun. 16, 1998

[54] FINGER DOOR GUARD AND METHOD OF COVERING THE GAP BETWEEN AN OPEN DOOR AND A DOOR FRAME

[76] Inventor: Albert W. Kapler, RR1 Box 1022, Lopez, Pa. 18628

[21] Appl. No.: 744,695

[22] Filed: Nov. 7, 1996

[51] Int. Cl.[6] ..... E05D 11/00

[52] U.S. Cl. ..... 49/383; 49/506; 16/250; 160/40

[58] Field of Search ..... 49/383, 384, 506; 16/250, 251, 221, 223; 160/229.1, 40

[56] References Cited

U.S. PATENT DOCUMENTS

| | | | |
|---|---|---|---|
| 2,641,792 | 1/1953 | Peeler . | |
| 2,681,480 | 6/1954 | Dixon . | |
| 2,694,234 | 6/1954 | Roby . | |
| 2,995,785 | 2/1961 | Hallenbeck . | |
| 3,319,697 | 5/1967 | Krohn . | |
| 4,040,142 | 8/1977 | Ippolito . | |
| 4,344,253 | 8/1982 | Stiles . | |
| 5,092,077 | 3/1992 | Teinturier-Milgram | 49/383 |
| 5,359,812 | 11/1994 | Mayfield . | |
| 5,419,084 | 5/1995 | Sankey . | |

FOREIGN PATENT DOCUMENTS

| | | | |
|---|---|---|---|
| 2641820 | 7/1990 | France | 49/383 |
| 4207385 | 9/1993 | Germany | 49/383 |

*Primary Examiner*—Jerry Redman
*Attorney, Agent, or Firm*—Plevy & Associates

[57] ABSTRACT

The present invention involves a finger door guard device and method for covering the gap between an open door and its frame. The guard protects children or others from getting their fingers pinched by this gap when the door is moved from an open to a closed position. The guard is comprised of an elongated member having two edges, one of which is pivotally attached to the door frame, and the other of which is free-standing and rests against the surface of the door. The bottom surface of the guard is spring biased to the door frame so that the finger guard is biased to move with the door as it opens and closes. The method involves pivotally attaching a member to a door frame and biasing the surface of the member toward the frame.

21 Claims, 4 Drawing Sheets

FINGER DOOR GUARD AND METHOD OF COVERING THE GAP BETWEEN AN OPEN DOOR AND A DOOR FRAME

FIELD OF THE INVENTION

This invention pertains to a door guard for covering the gap that is formed between a door and its frame when the door is open; the guard prevents children or others from inserting or accidentally putting their fingers in this gap and thus prevents their fingers from being pinched in the gap when the door is closed. The invention further pertains to a method of covering the gap between an open door and its frame.

BACKGROUND OF THE INVENTION

This invention relates to a finger door guard to prevent children or others from getting their fingers pinched in doors. When a door is in an open position, a gap is usually formed between the door and its jamb or the frame surrounding the door. Children, being curious, have been known to stick their fingers in this gap. Also, adults may accidentally allow their fingers to fall in this gap, when leaning against the door frame, etc. When the door is closed, the gap is closed as well, so that a person's fingers stuck in the gap will be pinched or crunched upon closing the door.

The prior art contains a number of door guards that could be applied to address this problem. For example, U.S. Pat. No. 2,681,480 issued to Dixon on Jun. 3, 1953, entitled "Finger Guard for Swinging Doors," shows a guard constructed with several different panels, including a U-shaped panel, a C-shaped panel, an L-shaped member, and a tubular-shaped section which projects into the hinge of the door.

Similarly, U.S. Pat. No. 4,040,142, issued to Ippolito on Aug. 9, 1977, entitled "Safety Device More Particularly for Rabbet of Door," shows a door guard. The guard in the Ippolito patent has four parallel panels; two outer panels are attached to the door and the frame, respectively, and two inner panels fold over each other as the door is closed. Ippolito specifically notes the dangers door gaps present to little children.

Other patents show door guards used to cover the gap formed between a door and its jamb for other reasons besides protecting the fingers of children and others. For example, U.S. Pat. No. 4,344,253 issued to Stiles on Aug. 17, 1982, entitled "Door Edge and Hinge Guard," shows a door guard for deflecting objects, such as shopping carts. That door guard comprises a U-shaped member, spaced parallel arms, and a right angular flange formed on the end of one of the parallel arms for attaching the member to the door frame or jamb.

As can be seen, a common feature of many of these prior art patents involving door guards is that they use resilient or flexible guard panels that bend, fold, or slide to cover the gap between the door and the door jamb. Also, many of them are fixedly attached to both the door and the door jamb or frame, resulting in the need for a plurality of folding or bending parts between the points of attachment, and/or they require that the guards exhibit flexibility or resiliency. In addition to the above-mentioned patents, other examples include U.S. Pat. No. 5,419,084 issued to Sankey on May 30, 1995, entitled "Door Jamb Finger Guard" (showing a guard having various folding parts); U.S. Pat. No. 5,359,812 issued to Mayfield on Nov. 1, 1994, entitled "Finger Guard" (showing a guard having a sliding device with a pocket); U.S. Pat. No. 3,319,697 issued to Krohn on Jun. 22, 1965, entitled "Garage Door Guard" (showing a guard having a panel, a bracket, hinge pins, etc); U.S. Pat. No. 2,995,785 issued to Hallenbeck on Feb. 28, 1958, entitled "Door Guard" (showing a guard having sliding resilient members): U.S. Pat. No. 2,694,234 issued to Roby on Jun. 26, 1953, entitled "Finger Guard for Swinging Doors" (showing a guard with a pair of panel sections, a thin intermediate section, and a number of beads for pivotally connecting the pieces of the guard); and U.S. Pat. No. 2,641,792 issued to Peeler on Jan. 17, 1950, entitled "Hinge Guard" (showing a hinge guard constructed of rubber or a similarly resilient material with portions having differing thicknesses and flexibility).

A rigid and substantially uniform door guard would provide advantages over these devices. A flexible member cannot be painted to match the decor of the door or of the surrounding room, because the paint will likely chip off the guard when the guard flexes. Thus, flexible guards must be stained or constructed of a pre-determined color, whereas a rigid guard could be sold in any color or in a plain color adapted to be painted by the consumer.

As the above background reveals, there is a need for an improved and simplified finger door guard device, that is, one that is easy to construct, easy to mount on the door, and easy to use, and one that involves few interconnecting parts and does not necessarily require resiliency or flexibility.

SUMMARY OF THE INVENTION

Summarily described, the invention embraces a finger guard device comprised of an elongated member having two elongated edges. One edge of the elongated member is designed to be pivotally attached to the door frame. The second edge is a free edge. The member is of sufficient width to extend from the door frame, cover the gap between the door frame and the open door, and rest against the surface of the door. The bottom surface of the member is adapted to be spring biased to the door frame.

As applied to a door, one edge of the member is pivotally attached to the door frame; the bottom surface of the member is spring biased toward the frame; and the second free edge of the member rests adjacent the surface of the door. Thus, as the door is moved from an open to a closed position, the member pivots at is first edge, is biased toward the door and thus presses against the door at its second free edge, and is pushed by the door to move in the same direction as the door. Similarly, the method of covering the gap involves pivotally attaching an elongated edge of an elongated member to a door frame and biasing the surface of the member toward the door.

BRIEF DESCRIPTION OF THE DRAWINGS

For a better understanding of the present invention, an exemplary embodiment of the invention is described below, considered together with the accompanying drawings, in which.

DETAILED DESCRIPTION OF THE DRAWINGS

Figure 1A:
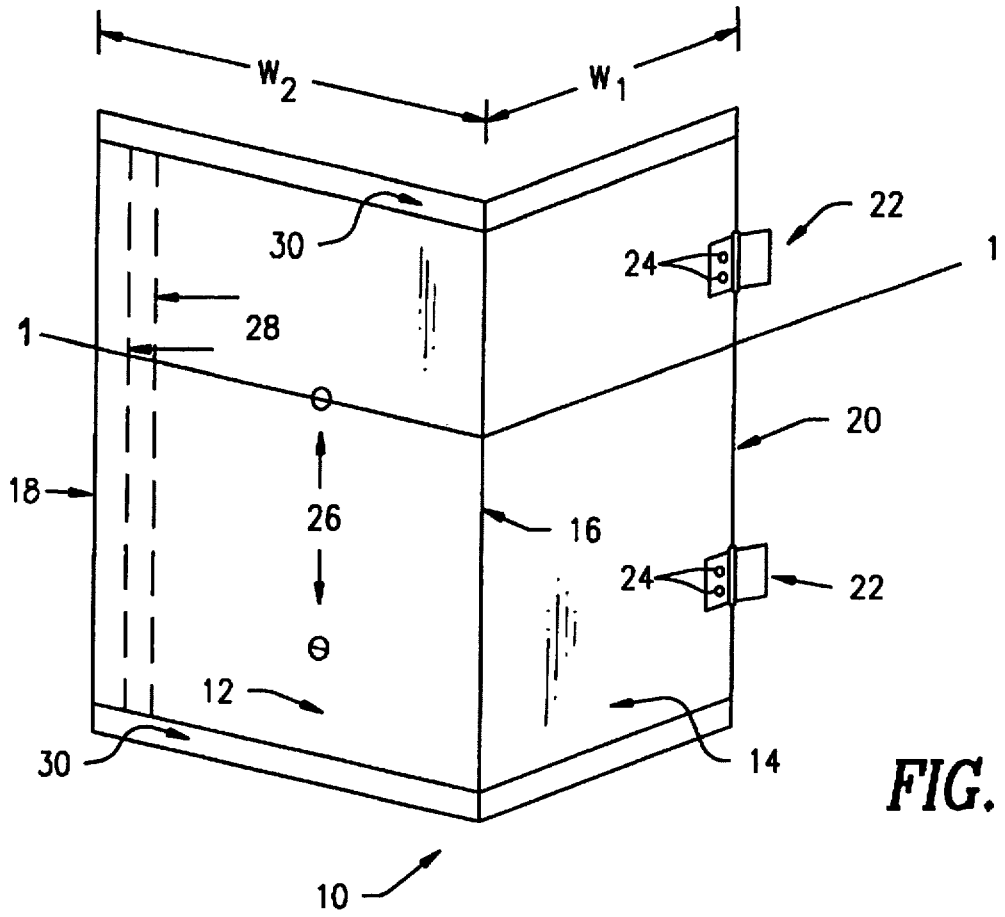
FIG. 1A is a schematic view of one embodiment of the finger door guard, looking at the outer surface of the guard.

Referring to FIG. 1A, there is shown the finger door guard 10, formed as an L-shaped member with two panels, a wider panel 12 and a more narrow panel 14. In the embodiment shown, the L-shaped member is a unitary member, with the panels 12 and 14 being defined by a fold or bend 16 in the member along its length. The finger door guard is preferably a unitary member, as this promotes ease of construction and durability, but it can also be formed from two separate panels that are glued, welded, or otherwise secured together. In the preferred embodiment, the member is constructed from a rigid metal material, such as aluminum or stainless steel; however, other materials are also contemplated, such as wood or plastics, with the aim being that the finger guard be sufficiently rigid to be capable of being spring biased against the door frame, as will be later explained.

Figure 3A:
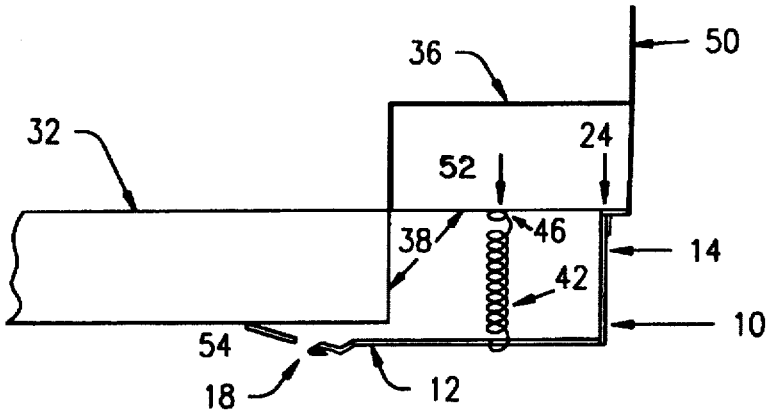
FIG. 3A shows a cross-sectional view of the finger door guard attached to a door frame, showing a cut-away section of the adjacent door in the open position.
Figure 3B:
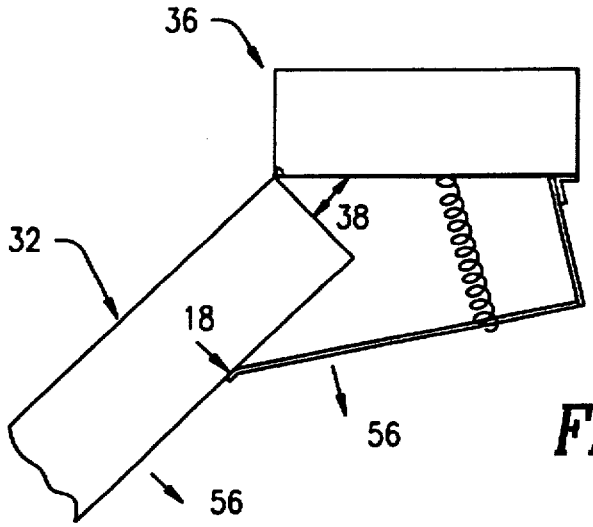
FIG. 3B shows the door guard and door as in FIG. 3A, with the door in a partially closed position.
Figure 3C:
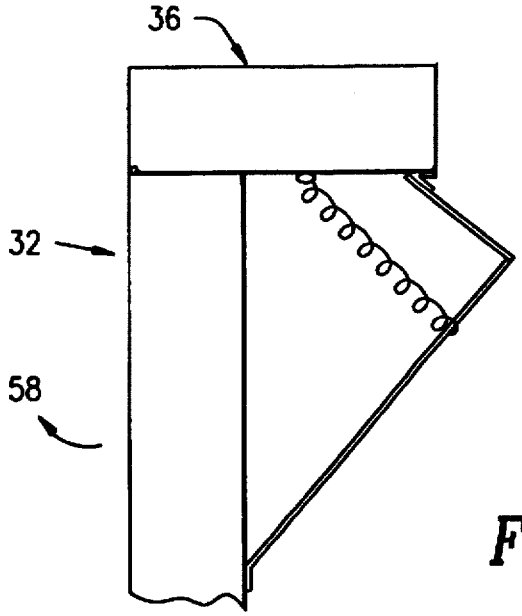
FIG. 3C shows the door guard and door as in FIG. 3A, with the door in a fully closed position.

The wider panel 12 has an elongated edge 18, and the narrow panel 14 has an elongated edge 20. Hinges 22 are attached by screws 24 to the elongated edge 20 of the narrow panel 14 for pivotally securing the door guard to a door frame (as shown in FIGS. 3A–3C). Although two hinges are shown, it should be understood that different numbers of hinges may be used, and also, any method of pivotally attaching the door guard to the door frame may be used as well. Although the hinges are preferably secured to the exterior surface of the guard (as shown), they may be secured to the underside or inner surface as well.

On the wider panel 12, there is shown the heads of two screws 26 which extend through an aperture in the door guard; the screws 26 secure springs to the underside of the guard (which are shown in FIG. 2 at numeral 42). Creases 28 are disposed along the length of the wider panel 12 and adjacent to its edge 18 to provide flexibility to this edge of the finger guard. An optional band or covering 30 may be placed around the top and bottom rim of the finger guard to soften any exposed edges.

Figure 1B:
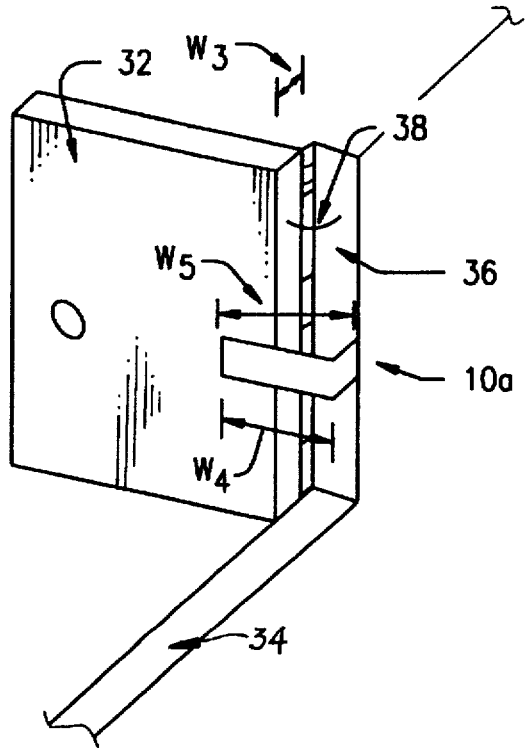
FIG. 1B shows a door to which is attached a sliced section of the door guard.

The width W1 of the narrow panel is approximately two inches, and the width W2 of the wider panel is approximately four inches. However, it should be understood that various shapes and sizes may be used, and the size of the door guard can be modified depending upon the size of the door to be guarded. More particularly, with regard to the size of the guard, reference is made to FIG. 1B. In FIG. 1B, a door 32 is shown in an open position, exposing the door stop 34, the frame 36, and the gap 38 that is formed between the door and the door frame when the door is open. An upper section of the door guard 10*a* (sliced along the line 1—1 of FIG. 1A) is shown attached to the frame 36. The aim with regard to the size of the guard is that the narrow panel 14 should have a width W1 that is greater in width than the cross-sectional width W3 of the door to be guarded, and the wider panel 12 should have a width W2 that is greater than the width W4 extending from the door frame 36 across the gap 38 and abutting the surface of the door. Overall, the width extending from one edge of the guard 20 to the other edge 18 should be equal or greater to the width W5, which is the distance from the door frame, over the gap, and over part of the surface of the door.

Figure 2A:
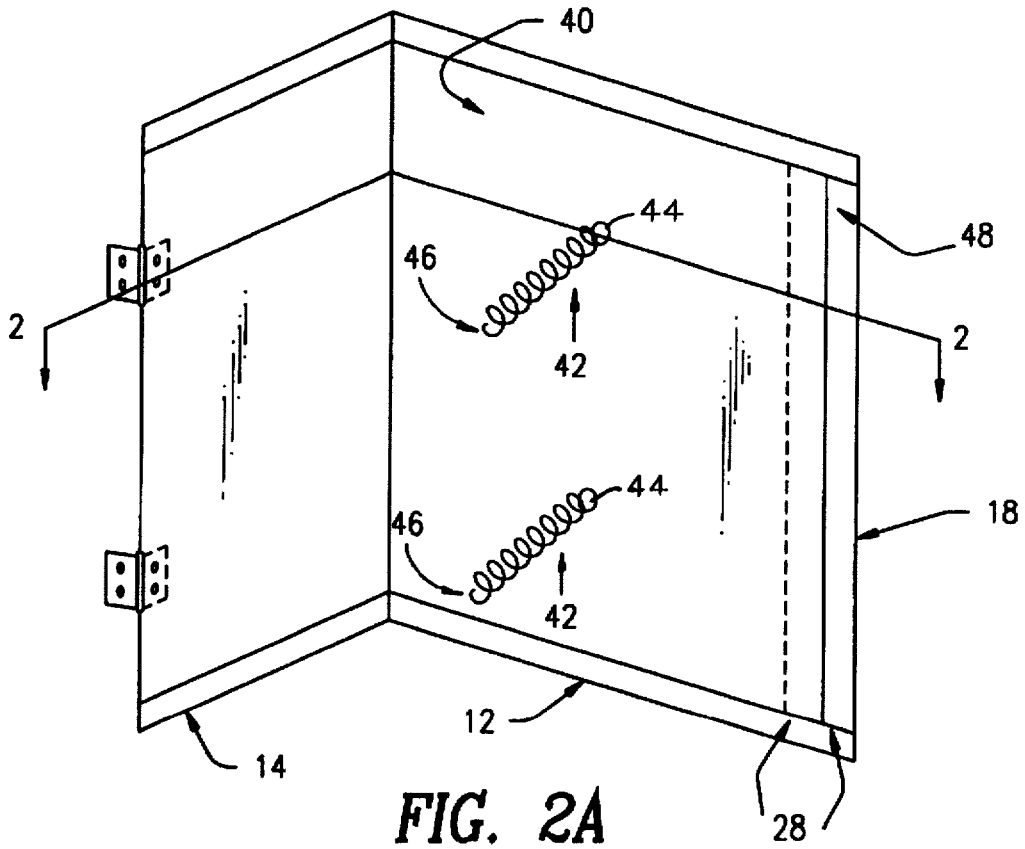
FIG. 2A shows one embodiment of the finger door guard, looking at underside or inner surface of the guard (from the opposite direction of FIG. 1A).

Referring now to FIG. 2A, there is shown the underside or inner surface 40 of the door guard. Two springs 42 are shown secured to the inner surface of the guard with nuts 44 which are threaded onto screws 26 (shown in FIG. 1A). At the end of each spring, there is a hook 46 for removably connecting the guard to the door frame. Although springs are shown, it should be understood that other methods of biasing the finger door guard to the door frame or door can be used, such as durable elastic or BUNGIE cords. Also, although two springs are shown, any number of biasing means can be used.

Figure 2B:
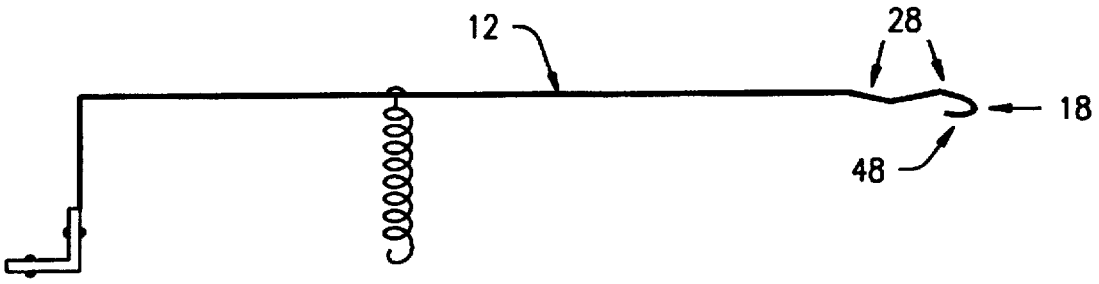
FIG. 2B shows a cross-sectional view of the finger door guard along the line 2—2 of FIG. 2A.

Referring now to FIG. 2B, there is shown the cross-sectional view of the door guard along the line 2—2 of FIG. 2A, revealing in greater detail the creases 28 disposed along the length of the wider panel 12 and adjacent to its edge 18. The edge 18 also is turned under to define a fold 48, so that the edge 18 of the wider panel is smooth; this edge will press against the door panel, as will be later explained, and thus, it is desirable for this edge to be smooth so that it does not damage the door as it presses against it.

Referring now to FIGS. 3A, 3B, and 3C, the door guard 10 is shown with a cross-sectional cut-away view of part of a door 32 and door frame 36. As shown in FIG. 3A, the door frame 36 abuts the wall 50 to the room or space to which the door opens. The narrow panel 14 of the door guard is pivotally secured to the door frame with the hinges 24. The wider panel 12 of the door guard is also connected to the door frame via the springs 42. A screw having a loop on its head 52 is threaded into the door frame 36, and the hook 46 at the end of the spring is inserted into the screw head 52. Other methods of connecting the spring to the door frame may be used as well, although it is preferable that the method of attachment be removable, so that the guard can be dismantled when no longer needed.

When the door is fully open as in FIG. 3A, the door guard is in a resting position, with little or no tension in the spring 42. The door guard fully covers the gap 38 between the door 32 and its frame 36. The edge 18 of the wider panel is free standing, but preferably, it should be touching or nearly touching the surface of the door 32, so that children cannot place their fingers in the space 54 between the guard and the door.

FIGS. 3B and 3C show the operation of the door guard when the door is moved from an open to a closed position. In FIG. 3B, the door is shown in a partially-closed position, with the door having been moved toward a closed position in the direction of arrow 56. As the door is closed in that direction, the surface of the door 32 presses against the edge 18 of the guard; the door guard swings on its hinges 24 and is pushed by the door also in the direction of arrow 56. The springs 42 are extended or stretched, thus biasing the guard against the door and enclosing the gap 38. As the door is moved to its fully closed position as shown in FIG. 3C, the door continues to press against the guard and push the guard in the direction of the moving door. Conversely, when the door is opened by moving it in the direction of arrow 58 in FIG. 3C, the springs pull the guard back toward its resting position, shown in FIG. 3A.

Figure 4A:
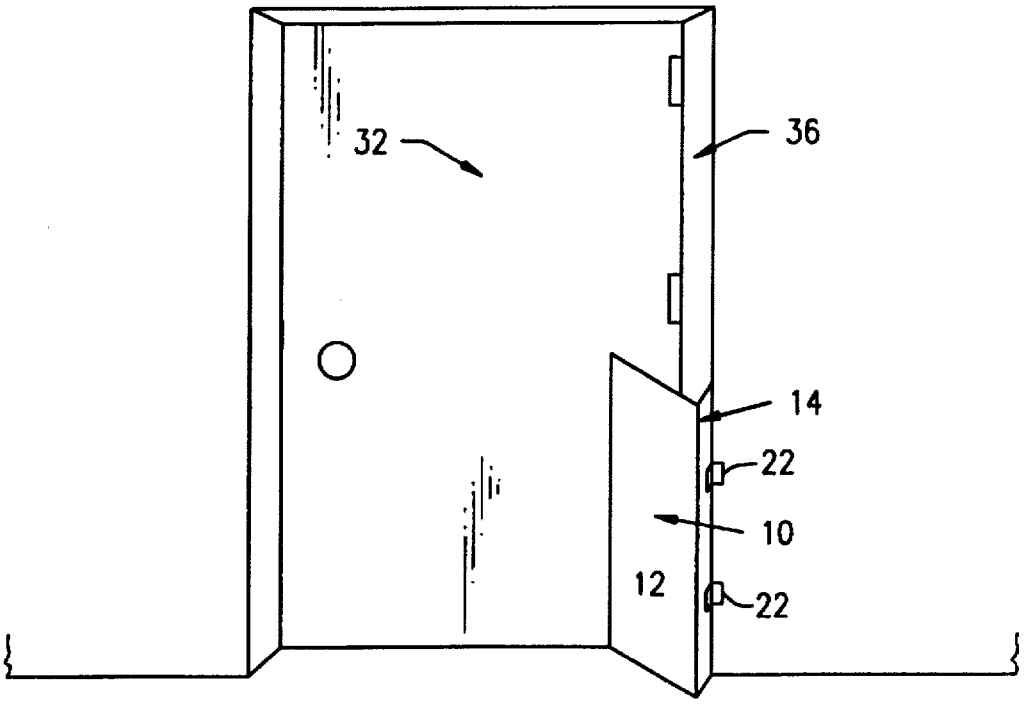
FIG. 4A shows a door with the finger door guard attached to the door frame, showing the door in the closed position.
Figure 4B:
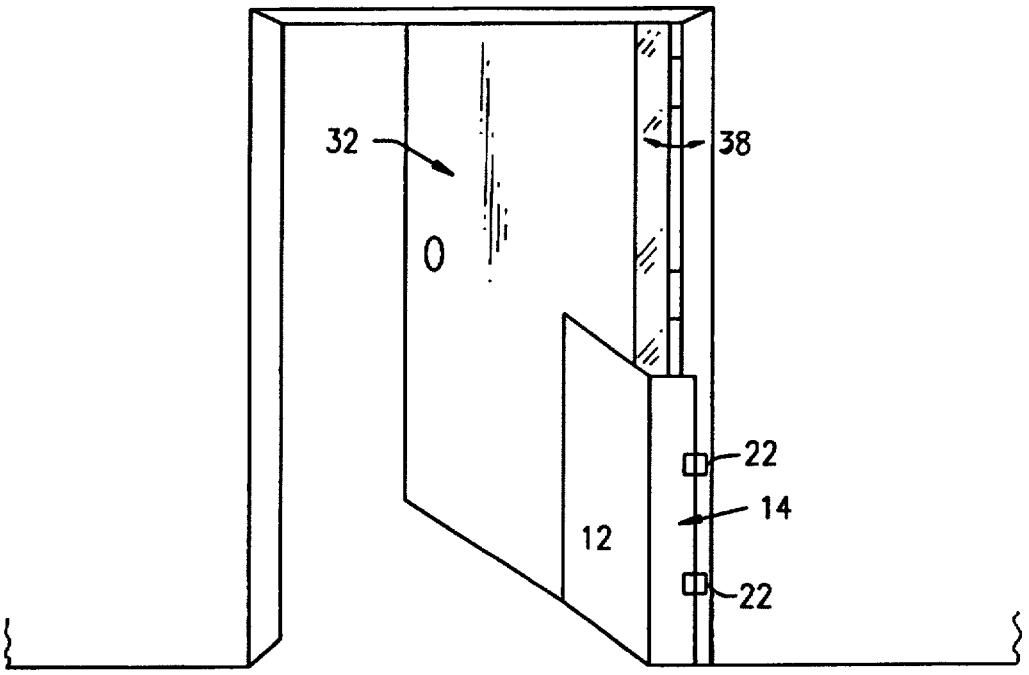
FIG. 4B shows the view of FIG. 4A with the door in the open position.

Referring now to FIGS. 4A and 4B, the door guard is shown in full view in conjunction with a door 32. FIG. 4A shows the door in a closed position, so that the guard 10 is biased against the door and the wider panel of the guard 12 is disposed diagonally across the door frame 36. FIG. 4B shows the door in an open position, with the guard in its resting position adjacent the door 32 and covering the gap 38. The guard may extend for the entire height of the door or it may extend over a selected portion of the door, as shown in FIGS. 4A and 4B.

Although the door guard is shown as an L-shaped member, which is preferable, it can also take the form of other shapes as well. For instance, it can take the form of a U-shape, a C-shape, or an S-shape. The aim with regard to the size and shape of the guard is that it should have one or more panels for covering the gap 38 (over the distance W5 as shown in FIG. 1A), and further, that its shape should permit it to pivot at one end on the door frame as the other end rests against the door and is pushed by movement of the door.

It will be further understood that the embodiments described herein are merely exemplary and that a person skilled in the art may make variations and modifications without departing from the spirit and scope of the invention. All such variations and modifications are intended to be included within the scope of the appended claims.

I claim:

1. A device to be used with a door of a type having a planar surface pivotally attached to a door frame wherein a gap is formed between the door and the frame when the door is in an open position, the device being configured to cover the gap that is formed between the door and the door frame when the door is in the open position, the device comprising:

an elongated member having an elongated edge along its length and an inner surface, the elongated member being of sufficient width so that when the elongated edge is attached to the door frame, the elongated member extends from the door frame and covers part of the planar surface of the door when the door is in an open position;

pivot means disposed on the elongated edge of the elongated member for pivotally attaching the elongated edge to the door frame; and, biasing means disposed on the elongated member for biasing the elongated member toward the door frame, wherein the biasing means pulls the elongated member toward the door frame so that the elongated member pivots at the elongated edge and moves with movement of the planar surface of the door.

2. The device according to claim 1, wherein the elongated member has a narrow panel and a wider panel, both panels having a first edge and a second edge; wherein the first edge of the narrow panel defines the elongated edge; wherein the second edge of the narrow panel is attached to the first edge of the wider panel; and wherein the second edge of the wider panel defines a free edge that presses against the door when the door is in a closed position.

3. The device according to claim 2, wherein the wider panel contains at least one crease along its length adjacent its second edge for providing flexibility to the elongated member as it presses against the door.

4. The device according to claim 1, wherein the elongated member is L-shaped.

5. The device according to claim 1, wherein the elongated member is comprised of a unitary rigid piece of material.

6. The device according to claim 1, wherein the elongated member is fabricated with a metal material selected from the group consisting of stainless steel and aluminum.

7. The device according to claim 1, wherein the pivot means further comprises at least one swinging hinge.

8. The device according to claim 1, wherein the biasing means further comprises at least one spring with two ends, wherein one end of the spring is attached to the inner surface of the elongated member, and wherein the other end of the spring is adapted to be attached to the door frame.

9. The device of claim 1, wherein both the pivot means and the biasing means comprise a spring-loaded hinge.

10. A finger door guard to be used with a door of a type having a planar surface pivotally attached to a door frame wherein a gap is formed between the door and the door frame when the door is in an open position, the finger door guard being designed for covering the gap that is formed between the open door and the door frame, the finger door guard comprising:

an elongated member having a predetermined width comprising a first narrow panel and a second wider panel, wherein both panels have inner surfaces, respectively, a first edge, and a second edge; wherein the second edge of the narrow panel is connected to the first edge of the wider panel; and wherein the width of the elongated member from the first edge of the narrow panel to the second edge of the wider panel is greater than a distance extending from the door frame over the gap and over a portion of the planar surface of the door;

pivot means disposed on the first edge of the narrow panel for pivotally attaching the elongated member to the door frame;

biasing means disposed on the elongated member for biasing the elongated member toward the door frame and door so that, when the elongated member is pivotally attached at its first edge to the door frame, the biasing means pulls the elongated member toward the door frame and presses the second edge of the wider panel against the door so that the elongated member moves with movement of the door.

11. The finger door guard according to claim 10, wherein the elongated member is L-shaped.

12. The finger door guard according to claim 10, wherein the elongated member is fabricated with a rigid metal material.

13. The finger door guard according to claim 10, wherein the pivot means further comprises at least one swinging hinge.

14. The finger door guard according to claim 10, wherein the wider panel contains at least one crease along its length adjacent its second edge for providing flexibility to the elongated member as it presses against the door.

15. The finger door guard according to claim 10, wherein the elongated member is comprised of a unitary and rigid L-shaped piece of material; wherein the pivot means further comprises at least one swinging hinge; wherein the biasing means further comprises at least one spring with two ends, wherein one end of the at least one spring is attached to the inner surface of the wider panel of the elongated member, and wherein the other end of the at least one spring is adapted to be attached to the door frame.

16. The finger door guard according to claim 15, wherein the wider panel contains at least one fold in its surface adjacent the second edge of the wider panel.

17. A method for protecting people's fingers from being pinched by doors of a type having a planar surface pivotally attached to a door frame wherein a gap is formed between the door and the frame when the door is in an open position, the method comprising the steps of:

(a) pivotally attaching one edge of an elongated member having a pre-determined width to the door frame so that the width of the elongated member covers the gap and extends over part of the surface of the door; and, (b) biasing the elongated member to the door frame so that the elongated member is pulled toward the door frame and the door such that, when the door is moved from an open position to a closed position, the elongated member presses against the door and is pushed by the door to move with the planar surface of the door.

18. The method according to claim 17, wherein the step of pivotally attaching the elongated member (step a) is performed by attaching one end of a swinging hinge to the elongated member and the other end of the swinging hinge to the door frame.

19. The method according to claim 17, wherein the step of biasing the elongated member to the door frame (step b) is performed by attaching one end of a spring to the elongated member and the other end of the spring to the door frame.

20. The method of claim 17, wherein the steps of pivotally attaching and biasing the elongated member to the door frame are performed by attaching one end of a spring-loaded hinge to the elongated member and the other end of the spring-loaded hinge to the door frame.

21. A finger door guard device to be used with a door of a type having a planar surface pivotally attached to a door frame wherein a gap is formed between the door and the door frame when the door is in an open position, the device being configured to cover the gap that is formed between the door and the door frame when the door is in the open position, the device comprising:

an elongated member having an elongated edge along its length and an inner surface, the elongated member being of sufficient width so that when the elongated edge is attached to the door frame, the elongated member extends from the door frame and covers part of the planar surface of the door when the door is in an open position;

a spring-loaded means attached to the inner surface of the elongated member and biasing the elongated member toward the door frame and the door so that the elongated member moves with movement of the door.

* * * * *